US007864004B2

(12) United States Patent
Dominguez et al.

(10) Patent No.: US 7,864,004 B2
(45) Date of Patent: Jan. 4, 2011

(54) ACTIVATION FOR SWITCHING APPARATUS

(75) Inventors: Victor Elviro Dominguez, Madrid (ES); Jorge Juan Bonilla Hernandez, Madrid (ES); Manuel Meana Alcon, Madrid (ES); Thomas Helmut Frisch, Herne (DE)

(73) Assignee: General Electric Company, Schenectady, NY (US)

( * ) Notice: Subject to any disclaimer, the term of this patent is extended or adjusted under 35 U.S.C. 154(b) by 215 days.

(21) Appl. No.: 11/618,077

(22) Filed: Dec. 29, 2006

(65) Prior Publication Data

US 2008/0157904 A1 Jul. 3, 2008

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 81/00*** | (2006.01) |
| ***H01H 75/12*** | (2006.01) |
| ***H01H 9/02*** | (2006.01) |
| ***H01H 13/04*** | (2006.01) |

(52) U.S. Cl. ..... 335/8; 335/202; 335/35; 335/11

(58) Field of Classification Search ..... 335/8–11
See application file for complete search history.

(56) References Cited

U.S. PATENT DOCUMENTS

| | | | | | |
|---|---|---|---|---|---|
| 2,810,048 | A | * | 10/1957 | Christensen | 200/293 |
| 2,922,004 | A | * | 1/1960 | Miller et al. | 335/36 |
| 3,281,565 | A | * | 10/1966 | Grady et al. | 200/330 |
| 3,288,965 | A | * | 11/1966 | Klein | 337/70 |
| 3,289,049 | A | * | 11/1966 | Middendorf | 361/643 |
| 3,290,627 | A | * | 12/1966 | Davis et al. | 335/9 |
| 3,842,376 | A | * | 10/1974 | Mune | 335/202 |
| 3,959,752 | A | * | 5/1976 | Strobel et al. | 335/10 |
| D248,944 | S | * | 8/1978 | Godfrey | D13/170 |
| 4,604,507 | A | * | 8/1986 | Roulet Dubonnet et al. | 218/156 |
| 4,616,200 | A | * | 10/1986 | Fixemer et al. | 335/35 |
| 4,929,919 | A | * | 5/1990 | Link et al. | 335/38 |
| 5,343,178 | A | * | 8/1994 | Bagalini | 335/59 |
| 5,467,069 | A | * | 11/1995 | Payet-Burin et al. | 335/42 |
| 5,898,351 | A | * | 4/1999 | Kurono et al. | 335/172 |
| 6,232,855 | B1 | * | 5/2001 | Malingowski et al. | 335/14 |
| 6,469,601 | B1 | * | 10/2002 | Miura et al. | 335/6 |
| 7,041,921 | B2 | * | 5/2006 | Kadan et al. | 200/293 |
| 2005/0230231 | A1 | * | 10/2005 | Kadan et al. | 200/51 R |

OTHER PUBLICATIONS

European Search Report; Application No. 07123676.4-2214; Mail date: May 21, 2008.

* cited by examiner

*Primary Examiner*—Anh T Mai
*Assistant Examiner*—Alexander Talpalatskiy
(74) *Attorney, Agent, or Firm*—Cantor Colburn LLP

(57) ABSTRACT

A circuit breaker is disclosed. The circuit breaker has a single pole module housing having a 1 W width with a first conduction path and a second conduction path disposed within the single pole module housing. The first and second conduction paths are electrically isolated from each other via an interior wall of the single pole module housing. A first activation mechanism is in operable communication with the first conduction path and a second activation mechanism is in operable communication with the second conduction path. The first activation mechanism is in operable communication with the first conduction path independent of the second activation mechanism and the second conduction path. The second activation mechanism is in operable communication with the second conduction path independent of the first activation mechanism and the first conduction path.

19 Claims, 3 Drawing Sheets

ACTIVATION FOR SWITCHING APPARATUS

BACKGROUND OF THE INVENTION

The present disclosure relates generally to switching devices, and particularly to circuit breakers. Extensive use of circuit breakers has promoted the development of standardized circuit breaker housing dimensions. For example, it is common that single pole circuit breakers sold in Europe for residential and/or lighting applications are contained within housings that are 18 millimeters wide. Similarly, it is common that single pole circuit breakers sold in the US for residential and/or lighting applications are contained within housings that are 0.75 inches wide. With careful allocation of the internal space, it is possible to increase the number of circuit protection devices within a housing of given envelope dimensions. For example, many circuit breaker housings having the standardized envelope dimensions to incorporate a single power pole now additionally include protection for a neutral pole. Further, circuit breakers that include two active power poles within the standard housing dimensions for a single pole breaker have been developed. Present circuit breakers having two active power poles within the aforementioned standardized envelope dimensions, which originally incorporated only a single power pole, utilize a common activation mechanism such that activation of one power pole similarly activates (or deactivates) the other power pole. Present circuit breakers also utilize an interconnected tripping mechanism such that a trip event on one power pole results in a trip event on the other. This results in a change of a conduction path for each power pole in response to an activation or trip event relating to only one power pole. Accordingly, the art may be advanced by an improved power pole interruption arrangement.

BRIEF DESCRIPTION OF THE INVENTION

An embodiment of the invention includes a circuit breaker with a single pole module housing having a 1 W width with a first conduction path and a second conduction path disposed within the single pole module housing. The first and second conduction paths are electrically isolated from each other via an interior wall of the single pole module housing. A first activation mechanism is in operable communication with the first conduction path and a second activation mechanism is in operable communication with the second conduction path. The first activation mechanism is in operable communication with the first conduction path independent of the second activation mechanism and the second conduction path. The second activation mechanism is in operable communication with the second conduction path independent of the first activation mechanism and the first conduction path.

Another embodiment of the invention includes a circuit breaker with a single pole module housing having a 1 W width with a first conduction path and a second conduction path disposed within the single pole module housing, the first and second conduction paths being electrically isolated from each other via an interior wall of the single pole module housing. The circuit breaker includes means for activation of the first conduction path and means for activation of the second conduction path. The activation means of the first conduction path is independent of the activation means of the second conduction path and the second conduction path; and the activation means of the second conduction path is independent of the activation means of the first conduction path and the first conduction path.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a circuit breaker with two circuit protection paths, each path having an independent conduction path, an independent trip mechanism, and an independent activation mechanism, also herein referred to as a toggle. The trip and activation mechanisms of each circuit protection path are appropriately coupled with the associated conduction path for opening and closing the associated conduction path on demand. Each circuit protection path within the circuit breaker includes both thermal and electromagnetic protection devices. In an embodiment, the circuit breaker accommodates two coils to provide electromagnetic protection, one coil for each conduction path, two bimetallic strips for thermal protection, one bimetal for each conduction path, and two arc chambers, one for each conduction path, to extinguish an electrical arc generated during an opening action of the circuit breaker. From the foregoing, it will be appreciated that independent protection is provided to two separate conduction paths, or circuits.

Figure 1:
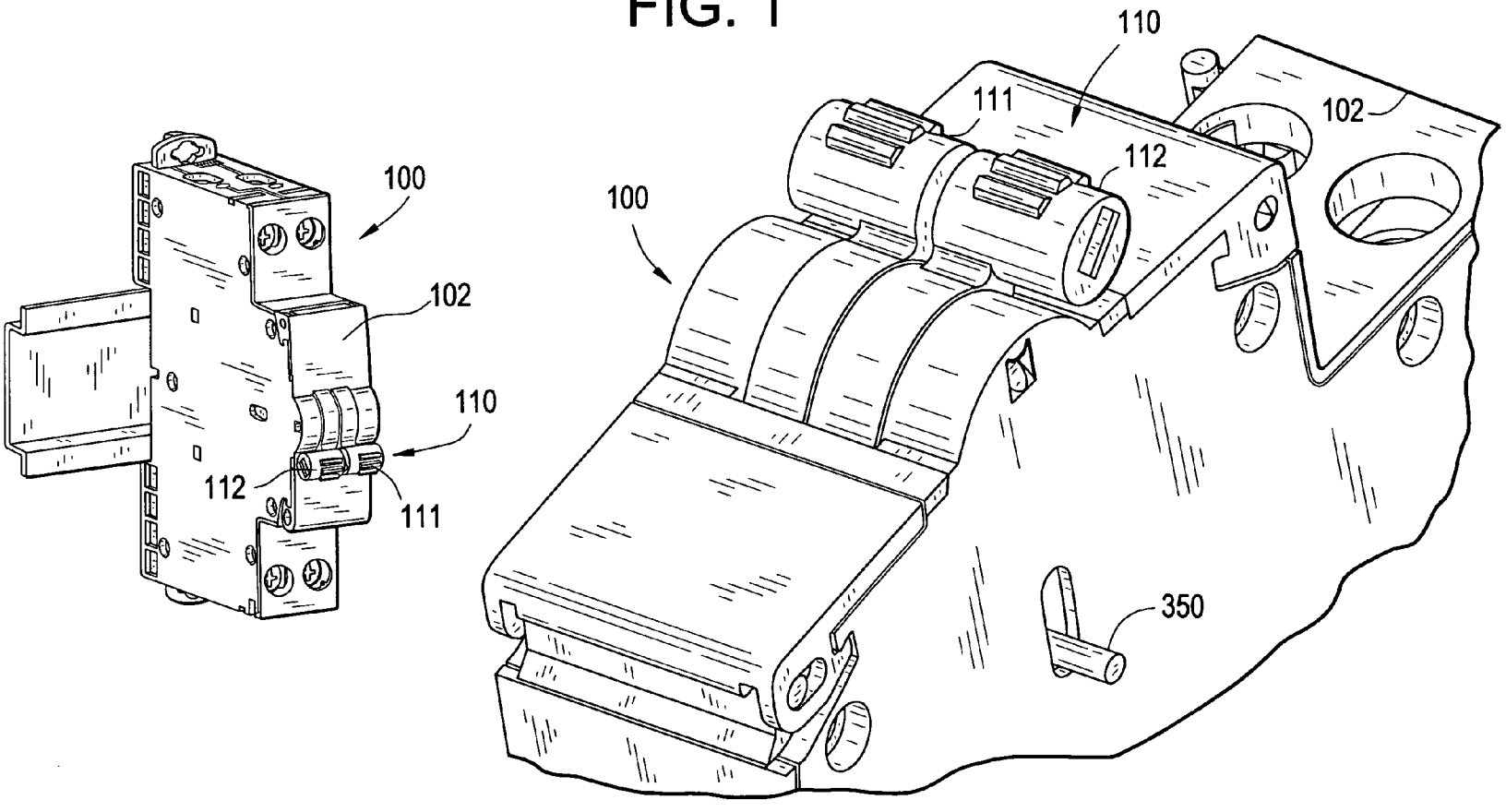
FIG. 1 depicts two perspective views of a double pole circuit breaker in accordance with an embodiment of the invention.

Referring now to FIG. 1, two views of a circuit breaker 100 having a double toggle 110, including independent toggles 111, 112 is depicted. As illustrated, the circuit breaker 100 includes two independent circuit protection paths, also herein referred to as poles, as will be described further below. As used herein, the term "independent circuit protection path" or "pole" shall refer to a circuit protection path that operates exclusive of a status of any other circuit protection path of the circuit breaker 100, and where the circuit protection path is absent either a mechanical or an electrical link with another circuit protection path. For example, a trip event on one independent pole will not influence or affect another independent pole of the circuit breaker 100, and operation of an activation mechanism corresponding to one independent pole will not influence or affect the other independent pole of the circuit breaker 100. A single pole module housing 102 of the circuit breaker 100 has envelope dimensions that are the same as standardized single-pole circuit breakers, such as 18 millimeters wide in Europe and 0.75 inches wide in the US, also herein referred to as a 1 W width, for example.

Figure 2:
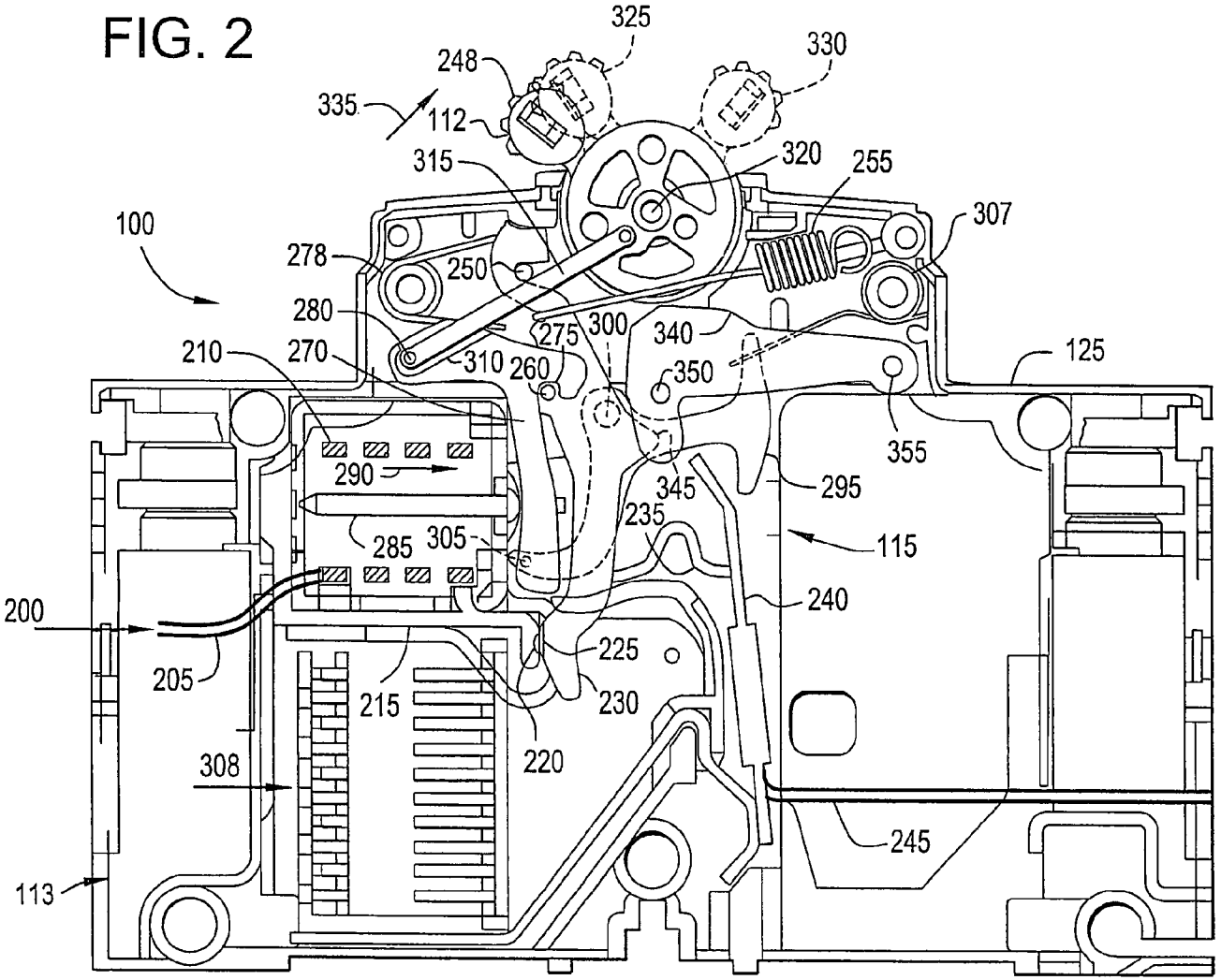
FIG. 2 depicts a cut away view of one pole of the double pole circuit breaker of FIG. 1 in accordance with an embodiment of the invention.

Referring now to FIG. 2, a cut away view of the circuit breaker 100 is depicted. The components in FIG. 2 define a first pole 113 of the circuit breaker 100, having an independent trip mechanism 115 and the independent toggle 112 (also herein referred to as a first activation mechanism) in operable communication with the independent trip mechanism 115. It will be appreciated that a second pole 114 (best seen with reference to FIG. 3) includes the independent toggle 111 (also herein referred to as a second activation mechanism) and a second independent trip mechanism disposed behind (into the plane of the page) the first pole 113. A base 125, also herein referred to as an interior wall, of the single pole module housing 102, serves as a central division of space within the circuit breaker 100, and a frame onto which the following components will be disposed. While not specifically illustrated, it will be appreciated that the second pole 114 is a mirror image layout of the first pole 113 depicted in FIG. 2, and likewise includes identical components. The following description is intended as an illustration of an independent pole 113, 114 within circuit breaker 100 having more than one independent poles 113, 114, each pole 113, 114 in independent operable communication with the respective independent trip mechanisms (such as trip mechanism 115 depicted in FIG. 2) and independent toggles 112, 111.

A current path 200, also herein referred to as a first conduction path, through pole 113 is depicted in FIG. 2, where current is supplied via a first circuit connection 201 (best seen with reference to FIG. 3) to a line conductor 205 in power connection with an electromagnetic protection device (also herein referred to as a coil) 210 (depicted in cross section view in FIG. 2). The coil 210 is in power connection with a contact holder 215 upon which a fixed contact 220 is disposed. Current will then flow from the fixed contact 220 to a movable contact 225 disposed upon a contact aim 230, through the contact arm 230, through a conductor 235, and to a thermal protection device (also herein referred to as a bimetallic strip) 240. The current will continue through a conductor 245 to a second circuit connection 246 (best seen with reference to FIG. 3). The contact arm 230 in FIG. 2 is depicted in a CLOSED position, corresponding to an ON position 248 of the toggle 112, to allow current flow through the current path 200. It will be appreciated that in response to a counterclockwise rotation of the contact arm 230 about a pivot 250, a mechanical and electrical separation between fixed contact 220 and movable contact 225 will result, thereby defining an OPEN position to interrupt the flow of current.

While not specifically illustrated it will be appreciated that a second conduction path through the second pole 114 is a mirror image of the first conduction path 200. The first conduction path 200 and the second conduction path are electrically isolated from each other via the base 125. Each of the first conduction path 200 and the second conduction path are independent of the other, and operate exclusive of a status of the other. Each of the first conduction path 200 and the second conduction path are absent either a mechanical or an electrical link with the other circuit protection path.

In an exemplary embodiment, a bias force is applied to the contact arm 230 via an extension spring 255. The bias force tends to cause counterclockwise rotation of the contact arm 230 about the pivot 250 to dispose the contact arm 230 in the OPEN position. The contact arm 230 includes a pin 260. A release link 270 is in operable communication with the pin 260 of the contact arm 230 via a hook 275. A bias force is applied to the release link 270 by a torsion spring 278. The bias force applied by the spring 278 tends to cause clockwise rotation of the release link 270 about a movable pivot 280, which will be described further below. As depicted in FIG. 2, the contact arm 230 is held in the CLOSED position by engagement of the pin 260 within the hook 275.

In an embodiment, the circuit breaker 100 provides electromagnetic circuit protection via the coil 210 in operable communication with the release link 270. In response to a large increase in current (as may result from an electrical short-circuit condition) that exceeds a predefined value, the coil 210 is configured to activate a plunger 285, which, in turn, will displace forward as indicated by a direction line 290. Operation of the coil 210, including activation of the plunger 285, in response to the large increase in current within the conduction path 200 of the first pole 113 is independent of, or absent either a mechanical or electrical link to, and does not effect a change of, components within the second pole 114, such as a coil. As the plunger translates forward, it contacts the release link 270, and causes the release link 270 to rotate in a counterclockwise direction about the pivot 280. In response to the clockwise rotation of the release link 270 about the pivot 280, the hook 275 releases the pin 260, and the contact arm 230, responsive to the bias force provided by the extension spring 255, rotates counterclockwise about the pivot 250 to the OPEN position. A bias force is applied to the plunger 285 via a spring (not shown) disposed within the coil 210. The bias force tends to cause the plunger 285 to translate opposite the forward direction 290, such that subsequent to the large increase in current, a resetting of the plunger 285 is automatically provided.

The circuit breaker 100 provides thermal protection via the bimetallic strip 240. As current flows through the bimetallic strip 240, heating will occur as a result of the material resistance. Heating of the bimetallic strip 240, in response to the current flow within the conduction path 200 of the first pole 113 is independent of, or absent either a mechanical or electrical link to, and does not effect a change of, components within the second pole 114, such as a bimetallic strip. This heating will cause a defined displacement at the free end of the bimetallic strip 240. If the current (and heating) exceed a defined threshold, the displacement of the bimetallic strip 240 contacts a thermal lever 295, and causes a counterclockwise rotation of the thermal lever 295 about a pivot 300. The thermal lever 295 is in operable communication with the release link 270 via a connection 305, such as a pin, or a cam surface, for example. In response to the counterclockwise rotation of the thermal lever 295, the connection 305 causes counterclockwise rotation of the release link 270 about the pivot 280. In response to the clockwise rotation of the release link 270 about the pivot 280, the hook 275 releases the pin 260, and the contact arm 230, responsive to the bias force provided by the extension spring 255, rotates counterclockwise about the pivot 250 to the OPEN position. A torsion spring 307 applies a bias force that tends to cause a clockwise rotation of the thermal lever 295, such that as the bimetallic strip 240 cools, a resetting of the thermal lever 295 to the position depicted in FIG. 2 is automatically provided.

In the art, the opening action via the coil 210 or bimetal 240 due to an overcurrent condition is referred to as a trip action. In an embodiment, an arc extinguishing device 308 is disposed proximate the fixed contact 220 and the moving contact 225, and extinguishes arcs that may be created during the trip action of the circuit breaker 100. In response to the trip action, as described above, the release link 270 rotates in a counterclockwise direction about the pivot 280. In response to the counterclockwise rotation of the release link 270, a shoulder 310 disposed upon the release link 270 contacts a link 315 in operable connection with the toggle 112 and the release link 270. In response to the contact of the shoulder 310 to the link 315, the link 315 causes the toggle 112 to rotate in a clockwise direction about a pivot 320 to a TRIPPED position 325, to provide a visual indication that the trip mechanism 115 has experienced the overcurrent condition leading to the trip action.

The toggle 112 is in operable communication with the first conduction path 200 independent of, or absent either a mechanical or electrical link to, and does not effect a change of, the toggle 111 and the second conduction path. Likewise, the toggle 111 is in operable communication with the second conduction path independent of, or absent either a mechanical or electrical link to, and does not effect a change of, the toggle 112 and the first conduction path 200.

The toggle 112 rotates from the ON position 248 to an OFF position 330 causing the contact arm 230 to rotate about the pivot 250 to the OPEN position. Rotation of the toggle 112 from the ON position 248 to the OFF position 330 is independent, or does not effect a change, of components within the second pole 114, including the toggle 111. The toggle 112 rotates from the TRIPPED position 325 to the OFF position 330 to effect a reset of the trip mechanism 115 following the trip action, as will be described further below. Rotation of the toggle 112 from the TRIPPED position 325 to the OFF position 330 is independent, or does not effect a change, of components within the second pole 114. Likewise, rotation of the toggle 111 corresponding to the second pole 114 is independent of components within the first pole 113, including the toggle 112.

While FIG. 2 depicts the toggle 112 in the ON position 248 as well as the TRIPPED position 325 and the OFF position 330, other components of the pole 113 are depicted in accordance with the CLOSED position of the contact arm 230. It will be appreciated by one skilled in the art that the other components will move according to the relationships disclosed and described herein.

In response to rotation of the toggle 112 clockwise from the ON position 248 to the OFF position 330, the link 315 causes translation of the pivot 280 and the release link 270 via a guidance groove (not visible) within the base 125 of the circuit breaker 100. The translation of the pivot 280 and release link 270, as defined by the guidance groove, is in a direction indicated by reference numeral 335. Further, the pin 260 remains engaged within the hook 275. The pin 260 therefore translates with the release link 270 thereby allowing rotation of the contact arm 230 about the pivot 250 to the OPEN position.

As described above, in response to the trip action, the release link 270 rotates counterclockwise about pivot 280, hook 275 disengages pin 260, and link 315 causes rotation of the toggle 112 to the TRIPPED position 325. In response to disengagement of the pin 260 from the hook 275, the bias force provided by the extension spring 255 causes rotation of the contact arm 230 counterclockwise about pivot 250 to the OPEN position.

In response to clockwise rotation of the toggle 112 from the TRIPPED position 325 to the OFF position 330, the link 315 causes translation of the pivot 280 and release link 270 via the guidance groove within the base 125 in the direction 335. In response to translation of the pivot 280 and the release link 270 to dispose the opening of the hook 275 proximate the position of the pin 260 corresponding to the OPEN position of the contact arm 230, the clockwise bias force provided by the torsion spring 278 causes the release link 270 to rotate about the pivot 280 thereby causing the hook 275 to engage the pin 260.

In response to rotating the toggle 112 from the OFF position 330 to the ON position 248, the link 315, via the guidance groove, causes the pivot 280 and the release link 270 to translate opposite the direction 335. Rotation of the toggle 112 from the OFF position 330 to the ON position 248 is independent, or does not effect a change, of components within the second pole 114. In response to the toggle 112 being in the OFF position 330, the pin 260 is engaged within the hook 275 of the contact arm 230. In response to the translation of the pivot 280 and the release link 270, the contact arm 230 rotates about the pivot 250 to the CLOSED position.

In an embodiment, an external tripping lever 340 is connected the contact arm 230 via a connector 345, such as a pin or cam surface, for example. The external tripping lever 340 includes a connector 350, (also visible with reference to FIG. 1) such as a pin, for example that extends in a direction out of the plane of the page. The connector 350 connects with an external interface (not shown), such as an interface to provide remote information regarding a status of the trip mechanism 115. In response to counterclockwise rotation of the contact arm 230 about the pivot 250 to the OPEN position, the connector 345 causes a clockwise rotation of the external tripping lever 340 about a pivot 355. In response to the clockwise rotation of the external tripping lever 340, the connector 350 translates in an upward direction, which translation the external interface senses as information regarding the status of the contact arm 230 of the trip mechanism 115.

While an exemplary embodiment of a trip mechanism has been described depicting a single contact arrangement utilizing a contact arm with one movable contact to interrupt current via rotary motion, it will be appreciated that the scope of the invention is not so limited, and that the invention also applies to other methods to interrupt current flow, such as contact arms that may utilize linear motion, or alternate contact arrangements, such as double contacts, for example. Further, while an exemplary embodiment has been described depicting an arc extinguishing device with one arc chute, it will be appreciated that the scope of the invention is not so limited, and that the invention also applies to other arc extinguishing arrangements, such as an extinguishing device with two arc chutes, for example.

The bimetallic strip 240 depicted in the exemplary embodiment of FIG. 2 depicts the conductors 235, 245 arranged so as to allow the current to flow through the length of the bimetallic contact, which is known in the art as a "direct heating" arrangement. It will be appreciated by one skilled in the art that alternate methods of conductor 235, 245 connection may be employed, such as "indirect heating", whereby the conductors 235, 245 are both attached at the end opposite the free end such that the length of current flow is comparatively short, and the resulting heat is transferred via thermal conduction within the bimetallic strip 240.

While an exemplary embodiment has been described with current flow through pole 113 in a first direction, it will be appreciated that scope of the invention is not so limited, and that the invention also applies to a circuit protection device through which current may flow in the opposite direction. While the current path has been described for one pole 113, it will be appreciated that an exemplary embodiment of the invention employs two poles 113, 114 as depicted in FIG. 3, for example.

Figure 3:
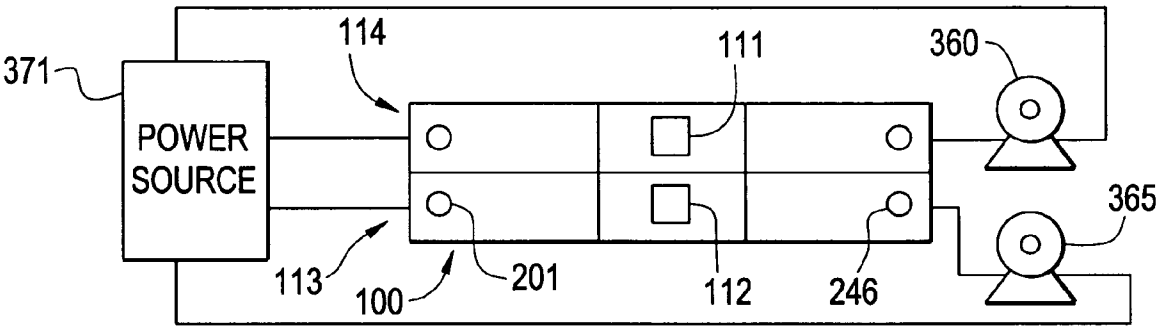
FIG. 3 depicts a schematic circuit diagram of a circuit breaker connection arrangement in accordance with an embodiment of the invention.

Referring now to FIG. 3, a schematic circuit utilizing an exemplary embodiment of the circuit breaker 100 is depicted. In the exemplary circuit of FIG. 3, each pole 113, 114 of the circuit breaker 100 is configured to provide independent circuit protection to each of two independent loads 360, 365 as connected to a power supply 370. As used herein, reference numerals 360, 365 may refer to any appropriate electrical load, such as a lighting fixture, or one-phase motor, for example.

Figure 4:
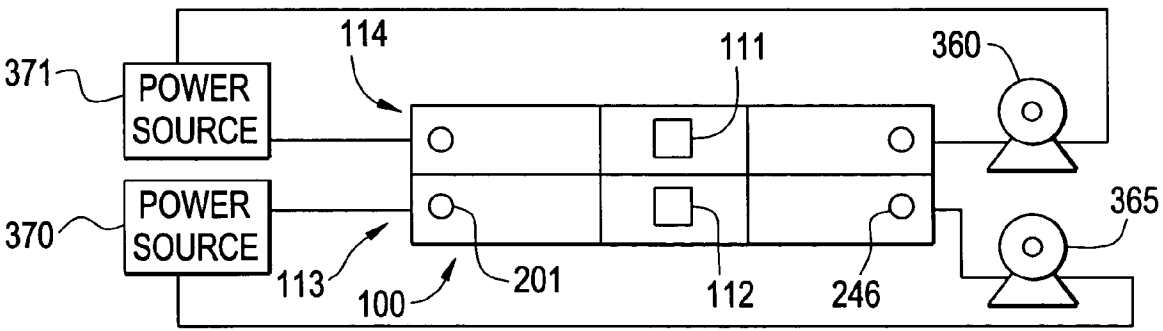
FIG. 4 depicts a schematic circuit diagram of a circuit breaker connection arrangement in accordance with an embodiment of the invention.

Referring now to FIG. 4, another schematic circuit utilizing an exemplary embodiment of the circuit breaker 100 is depicted. In the exemplary circuit of FIG. 4, each pole 113, 114 of the circuit breaker 100 is configured to provide independent circuit protection to each of two independent loads 360, 365 as connected to two independent power supplies 370, 371. It will be appreciated that power supplies 370, 371 may each be one power supply 370, 371 each in power connection with one independent load 360, 365, or may include more than one independent load 360, 365 in power connection with each independent power supply 370, 371.

As disclosed, some embodiments of the invention may include some of the following advantages: the ability to independently protect more than one pole of power within a circuit breaker having standardized single pole envelope dimensions; and the ability to independently control more than one pole of power within a circuit breaker having standardized single pole envelope dimensions.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A circuit breaker comprising:

a single pole module housing;

a first conduction path and a second conduction path disposed within the single pole module housing, each of the first and second conduction paths including a respective first circuit connection selectively connectable to a respective power supply and a respective second circuit connection selectively connectable to a respective load, the first and second conduction paths, including the first and second circuit connections, being electrically isolated from each other via an interior wall of the single pole module housing;

a first activation mechanism in operable communication with the first conduction path; and a second activation mechanism in operable communication with the second conduction path;

wherein the first activation mechanism is in operable communication with the first conduction path independent of the second activation mechanism and the second conduction path; and wherein the second activation mechanism is in operable communication with the second conduction path independent of the first activation mechanism and the first conduction path.

2. The circuit breaker of claim 1, wherein:

the first activation mechanism is in operable communication with the first conduction path absent a non-stationary mechanical link, relative to the housing, to the second activation mechanism, and absent a non-stationary mechanical link, relative to the housing, to the second conduction path; and the second activation mechanism is in operable communication with the second conduction path absent a non-stationary mechanical link, relative to the housing, to the first activation mechanism, and absent a non-stationary mechanical link, relative to the housing, to the first conduction path.

3. The circuit breaker of claim 1, wherein:

the first activation mechanism is in operable communication with the first conduction path absent an electrical link to the second conduction path; and the second activation mechanism is in operable communication with the second conduction path absent an electrical link to the first conduction path.

4. The circuit breaker of claim 1, wherein:

the first conduction path and the second conduction path are independent conduction paths.

5. The circuit breaker of claim 1, further comprising:

a first contact arm disposed within the single pole module housing, the first contact arm corresponding to the first conduction path; and a second contact arm disposed within the single pole module housing, the second contact arm corresponding to the second conduction path;

wherein the first contact arm and the second contact arm are mechanically and electrically independent of each other.

6. The circuit breaker of claim 5, further comprising:

a first electromagnetic protection device disposed within the single pole module housing, the first electromagnetic protection device corresponding to the first conduction path;

a second electromagnetic protection device disposed within the single pole module housing, the second electromagnetic protection device corresponding to the second conduction path;

wherein the first electromagnetic protection device and the second electromagnetic device are mechanically and electrically independent of each other.

7. The circuit breaker of claim 6, wherein the first and second electromagnetic protection device each comprise:

a coil disposed within the single pole module housing; and a plunger disposed within the coil, the plunger responsive to an increase in current flow through the coil that exceeds a predefined value to displace in a first direction and initiate an OPEN action of the contact arm.

8. The circuit breaker of claim 5, further comprising:

a first thermal protection device disposed within the single pole module housing, the first thermal protection device corresponding to the first conduction path;

a second thermal protection device disposed within the single pole module housing, the second thermal protection device corresponding to the second conduction path;

wherein the first thermal protection device and the second thermal protection device are mechanically and electrically independent of each other.

9. The circuit breaker of claim 8, wherein the first and second thermal protection device each comprise:

a bimetallic strip disposed within the single pole module housing, the bimetallic strip responsive to excessive current flow therethrough to displace in a first direction and initiate an OPEN action of the contact arm.

10. The circuit breaker of claim 5, further comprising;

a first arc extinguishing device disposed within the single pole module housing, the first arc extinguishing device corresponding to the first conduction path; and a second arc extinguishing device disposed within the single pole module housing, the second arc extinguishing device corresponding to the second conduction path.

11. A circuit breaker comprising:

a single pole module housing; and a first conduction path and a second conduction path disposed within the single pole module housing, each of the first and second conduction paths including a respective first circuit connection selectively connectable to a respective power supply and a respective second circuit connection selectively connectable to a respective load, the first and second conduction paths, including the first and second circuit connections, being electrically isolated from each other via an interior wall of the single pole module housing;

means for activation of the first conduction path; and means for activation of the second conduction path;

wherein the activation means of the first conduction path is independent of the activation means of the second conduction path and the second conduction path; and wherein the activation means of the second conduction path is independent of the activation means of the first conduction path and the first conduction path.

12. The circuit breaker of claim 11, wherein:

the first conduction path and the second conduction path are independent conduction paths.

13. The circuit breaker of claim 11, further comprising:

a first contact arm disposed within the single module housing, the first contact arm corresponding to the first conduction path; and a second contact arm disposed within the single pole module housing, the second contact arm corresponding to the second conduction path;

wherein the first contact arm and the second contact arm are mechanically and electrically independent of each other.

14. The circuit breaker of claim 13, further comprising:

a first electromagnetic protection device disposed within the single pole module housing, the first electromagnetic protection device corresponding to the first conduction path;

a second electromagnetic protection device disposed within the single pole module housing, the second electromagnetic protection device corresponding to the second conduction path;

wherein the first electromagnetic protection device and the second electromagnetic device are mechanically and electrically independent of each other.

15. The circuit breaker of claim 14, wherein the first and second electromagnetic protection device each comprise:

a coil disposed within the single pole module housing; and a plunger disposed within the coil, the plunger responsive to an increase in current flow through the coil that exceeds a predefined value to displace in a first direction and initiate an OPEN action of the contact arm.

16. The circuit breaker of claim 13, further comprising:

a first thermal protection device disposed within the single pole module housing, the first thermal protection device corresponding to the first conduction path;

a second thermal protection device disposed within the single pole module housing, the second thermal protection device corresponding to the second conduction path;

wherein the first thermal protection device and the second thermal protection device are mechanically and electrically independent of each other.

17. The circuit breaker of claim 16, wherein the first and second thermal protection device each comprise:

a bimetallic strip disposed within the single pole module housing, the bimetallic strip responsive to excessive current flow therethrough to displace in a first direction and initiate an OPEN action of the contact arm.

18. The circuit breaker of claim 13, further comprising;

a first arc extinguishing device disposed within the single pole module housing the first arc extinguishing device corresponding to the first conduction path; and a second arc extinguishing device disposed within the single pole module housing, the second arc extinguishing device corresponding to the second conduction path.

19. The circuit breaker of claim 1 wherein each activation mechanism includes an external connector protruding through a side wall of the housing, the external connector occupying a first position when a respective activation mechanism is in a CLOSED position and a second position when the respective activation mechanism is in an OPEN position.

* * * * *